US009222265B2

(12) United States Patent
Richmond et al.

(10) Patent No.: US 9,222,265 B2
(45) Date of Patent: Dec. 29, 2015

(54) INSULATING COVER FOR AN ATTIC SEALING MEMBER

(71) Applicant: YANKEE INSULATION PRODUCTS, LLC, New Boston, NH (US)

(72) Inventors: Matthew James Richmond, North Canton, OH (US); Mark James Richmond, New Boston, NH (US)

(73) Assignee: Yankee Insulation Products, LLC, New Boston, NH (US)

( * ) Notice: Subject to any disclaimer, the term of this patent is extended or adjusted under 35 U.S.C. 154(b) by 0 days.

(21) Appl. No.: 14/510,569

(22) Filed: Oct. 9, 2014

(65) Prior Publication Data

US 2015/0101272 A1 Apr. 16, 2015

Related U.S. Application Data

(60) Provisional application No. 61/889,764, filed on Oct. 11, 2013.

(51) Int. Cl.
*E04D 13/00* (2006.01)
*E04F 11/06* (2006.01)

(52) U.S. Cl.
CPC ..... *E04F 11/062* (2013.01)

(58) Field of Classification Search
CPC ..... E06B 1/04; E06B 9/02; E06B 3/26; E06B 7/16; E06B 5/01; E04H 9/16; E04F 13/00; E04F 1/62; E04F 19/08; E04F 11/04; B61D 17/16; E02D 29/12; E02D 29/14; E04B 9/001; E04B 9/003; E04B 1/74
USPC ..... 52/19–20, 404.1, 404.4, 404.5, 407.3, 52/407.4, 202, 205, 317, 198–199, 169.6, 52/3; 49/503, 505
See application file for complete search history.

(56) References Cited

U.S. PATENT DOCUMENTS

| | | | | | |
|---|---|---|---|---|---|
| 3,350,823 | A | * | 11/1967 | Murray | 52/200 |
| 4,151,894 | A | | 5/1979 | Edwards | |
| 4,281,743 | A | | 8/1981 | Fuller | |
| 4,312,423 | A | * | 1/1982 | Helbig | 182/46 |
| 4,337,602 | A | * | 7/1982 | King | 52/202 |
| 4,550,534 | A | * | 11/1985 | Mariano et al. | 52/19 |
| 4,658,555 | A | * | 4/1987 | Steiner | 52/202 |
| 4,832,153 | A | | 5/1989 | Daw et al. | |

(Continued)

OTHER PUBLICATIONS http://thermadome.com/products/stair-cover, Therma-Dome Pull Down Attic Stair Cover, Yankee Insulation Products, LLC, 3 pages, Document is dated 2014 and was printed from the pertinent website on Oct. 9, 2014.

(Continued)

*Primary Examiner* — Beth Stephan
(74) *Attorney, Agent, or Firm* — Sand & Sebolt; Howard L. Wernow

(57) ABSTRACT

An insulating system comprises a cover and a generally rigid attic sealing member. The cover defines an interior chamber, and the interior chamber is filled with insulation. The cover further forms a cavity in the bottom of the cover, where the attic sealing member is received into the cavity. Together, the system raises the insulating value (R-value) of an area above an attic opening to a minimum R-value level required by many building codes. The cover may be filled with insulation through a slit or passage extending along the top of the cover.

20 Claims, 8 Drawing Sheets

(56) References Cited

U.S. PATENT DOCUMENTS

| | | | | | |
|---|---|---|---|---|---|
| 4,928,441 | A | * | 5/1990 | Daley | 52/19 |
| 5,271,198 | A | * | 12/1993 | Freeman | 52/202 |
| 5,475,955 | A | * | 12/1995 | Dickinson | 52/202 |
| 5,481,833 | A | * | 1/1996 | Williams | 52/19 |
| 5,628,151 | A | * | 5/1997 | Monat | 52/19 |
| RE36,975 | E | * | 12/2000 | Williams | 52/19 |
| 6,223,490 | B1 | * | 5/2001 | Wessley et al. | 52/404.1 |
| 6,701,676 | B1 | * | 3/2004 | Kompelien | 52/19 |
| 7,770,353 | B2 | * | 8/2010 | Olsen | 52/745.15 |
| 8,931,215 | B1 | * | 1/2015 | Cook et al. | 52/19 |
| 2004/0055819 | A1 | * | 3/2004 | Lynn et al. | 182/46 |
| 2004/0163345 | A1 | * | 8/2004 | Alderman | 52/404.1 |
| 2006/0258284 | A1 | * | 11/2006 | Melesky | 454/349 |
| 2007/0095608 | A1 | * | 5/2007 | Taylor | 182/78 |
| 2009/0094908 | A1 | * | 4/2009 | Krueger et al. | 52/202 |
| 2009/0277099 | A1 | * | 11/2009 | Ogieglo | 52/19 |
| 2010/0275536 | A1 | * | 11/2010 | Melesky | 52/186 |
| 2011/0265392 | A1 | * | 11/2011 | Uhl et al. | 52/20 |
| 2012/0060427 | A1 | * | 3/2012 | Taylor et al. | 52/2.14 |
| 2013/0219804 | A1 | | 8/2013 | Uhl et al. | |

OTHER PUBLICATIONS http://www.mass.gov/hed/docs/dhcd/cd/wap/waptechnicalmanual.pdf, Massachusetts Weatherization Assistance Program Technical Manual, Department of Housing and Community Development Division of Community Services Energy Conservation Unit, 95 pages, Document is undated but was printed from the pertinent website on Oct. 9, 2014.

* cited by examiner

INSULATING COVER FOR AN ATTIC SEALING MEMBER

CROSS-REFERENCE TO RELATED APPLICATION

This application claims priority from U.S. Provisional Application Ser. No. 61/889,764, filed Oct. 11, 2013, the disclosure of which is incorporated herein by reference.

BACKGROUND OF THE INVENTION

1. Technical Field

The present invention relates to an insulating system for use in buildings. More particularly, the present invention relates to a supplemental insulating cover for insulating attic openings. Specifically, the present invention relates to an insulating cover configured to fit over and receive therein a rigid insulating and sealing member atop an attic opening.

2. Background Information

Houses are commonly provided with a pull-down foldable ladder providing access to an attic. The attic opening is provided with a spring-loaded door which is pivotally mounted at one end. The foldable ladder is mounted to the top side of the door and such offers support to the ladder when it is unfolded, the foot of the ladder resting on the floor of a hallway or a room. The door is provided with a rope on the bottom side to pull the door downwardly so that the ladder can be unfolded to provide access to the attic.

The closure is generally located between two joists so that when the ladder is in a folded mode, it is located between the joists. Although insulation is commonly provided between the joists in the attic, for obvious reasons it is believed, the area surrounding and over the ladder is not. Moreover, it will be appreciated that the attic closure does not, in and of itself, provide a good seal with the opening in the attic floor. Thus, there is a crack or void through which hot air can be lost from the house in the winter and cold air in the summer, if the house is air conditioned. The heat loss through the stairwell, even though the area not provided with insulation is small, is considerable particularly in the colder climates. This, of course, results in greater heating bills. In a similar manner, an air-conditioned or cooled home in a warmer climate can allow hot air to flow into the living space, particularly, leading to greater costs to cool the living space within the home.

To combat these problems, devices are known to exist that cover attic openings, and many devices are known to cover attic openings having staircases in the folded position. Exemplary proposed solutions of others to combat these problems are shown in U.S. Pat. Nos. 5,628,151; 4,281,743, 4,658,555, 5,475,955, 4,151,894, 4,832,153; as well as in U.S. Pat. App. Publ. Nos.: 2004/0055819; 2013/0219804; and in a device commercially available for sale, known as a Therma-Dome® by Yankee Insulation Products, LLC of New Boston, N.H.

SUMMARY

Although these devices are somewhat satisfactory in insulating attic openings, in real world applications issues continue to exist with their insulation properties inasmuch as they still lack the insulation rating (R-value) equivalent of the surrounding attic floor space. One way of combatting these problems associated with the relatively low R-value of the above mentioned devices is draping loose insulation over or affixing it to such insulating cover units. However, this option does not ensure that the insulation remains in place when the cover is moved, and it does not guarantee a completely effective insulative barrier, since any voids in the insulation will diminish the desired effect of any additional insulation placed thereon. The present invention addresses these and other issues.

In one aspect, the invention may provide a manner in which an individual that is concerned about maintaining a consistent insulation rating between attic floor space and the area over attic openings may do so by neatly and evenly applying additional insulation to an existing attic opening insulating cover. One embodiment of the invention may provide a preformed containment area, which allows the individual to install one of a number of types of insulation (including, but not limited to fiberglass batt or blown-in cellulose insulation), to an even and consistent depth on all sides of the existing attic opening insulating cover.

In another aspect, an embodiment of the present invention is configured to meet the need for supplemental insulation as required by building code requirements or individual preference when a standalone device, such as an insulated attic cover lacks the required R-value. An embodiment of the invention may provide a supplemental cover having preformed panels to fit snugly over an existing insulated attic opening cover, and will form a container that allows an even distribution of an insulating material on the top and each of the four outer sides (or any combination thereof) of the existing attic insulating and sealing member.

In another aspect, the invention may provide an insulating supplemental cover to insulate an area above an attic opening, the supplemental cover comprising: a plurality of connected walls creating a box-like structure; an interior chamber defined by the inner surfaces of connected walls, said interior chamber adapted to house insulation therein; and a cavity defined by the outer surfaces of connected walls, the cavity adapted to receive a rigid attic insulating and sealing member at least partially therein.

In another aspect, an embodiment of the invention may provide an insulating system for placing within an attic above an opening, the system comprising: a rigid attic insulating and sealing member; and a supplemental cover defining a chamber therein for filling with insulation, and a cavity formed by the outer surface of the cover, wherein the sealing member is received at least partially in the cavity.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 5:
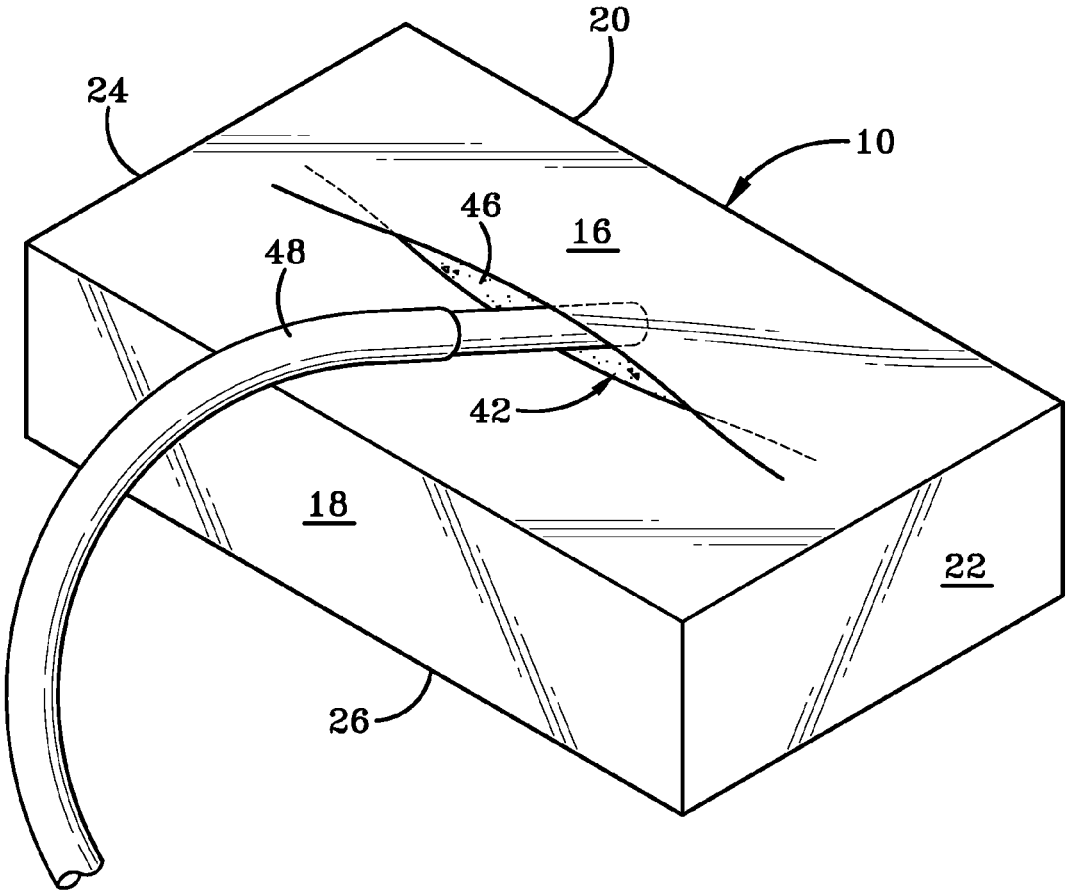
FIG. 5 is a perspective view of the supplemental insulating cover being filled with insulation from a hose inserted through a slit or passage.
Figure 6:
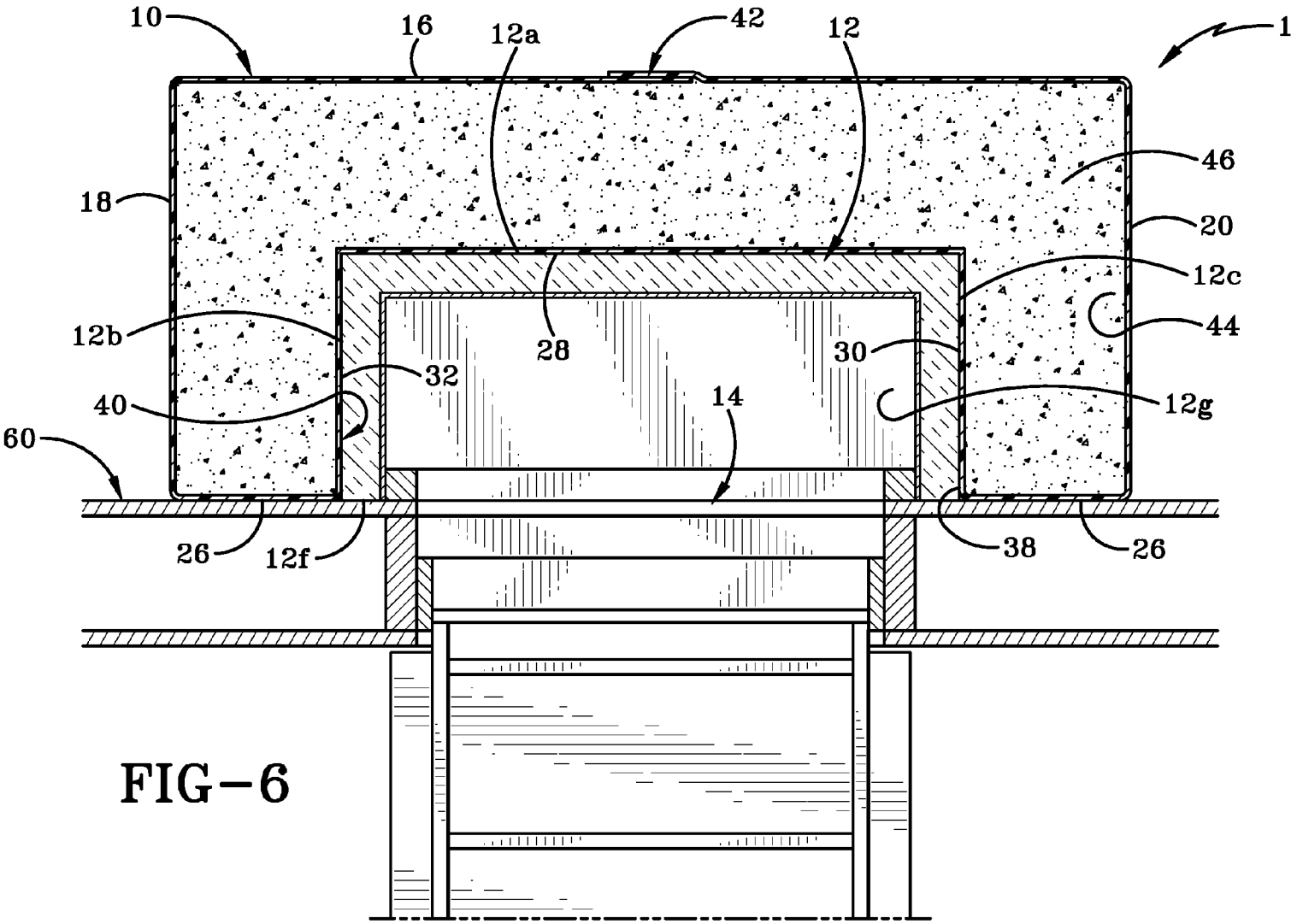
FIG. 6 is a cross-section view taken along line 6-6 in FIG. 2.
Figure 7:
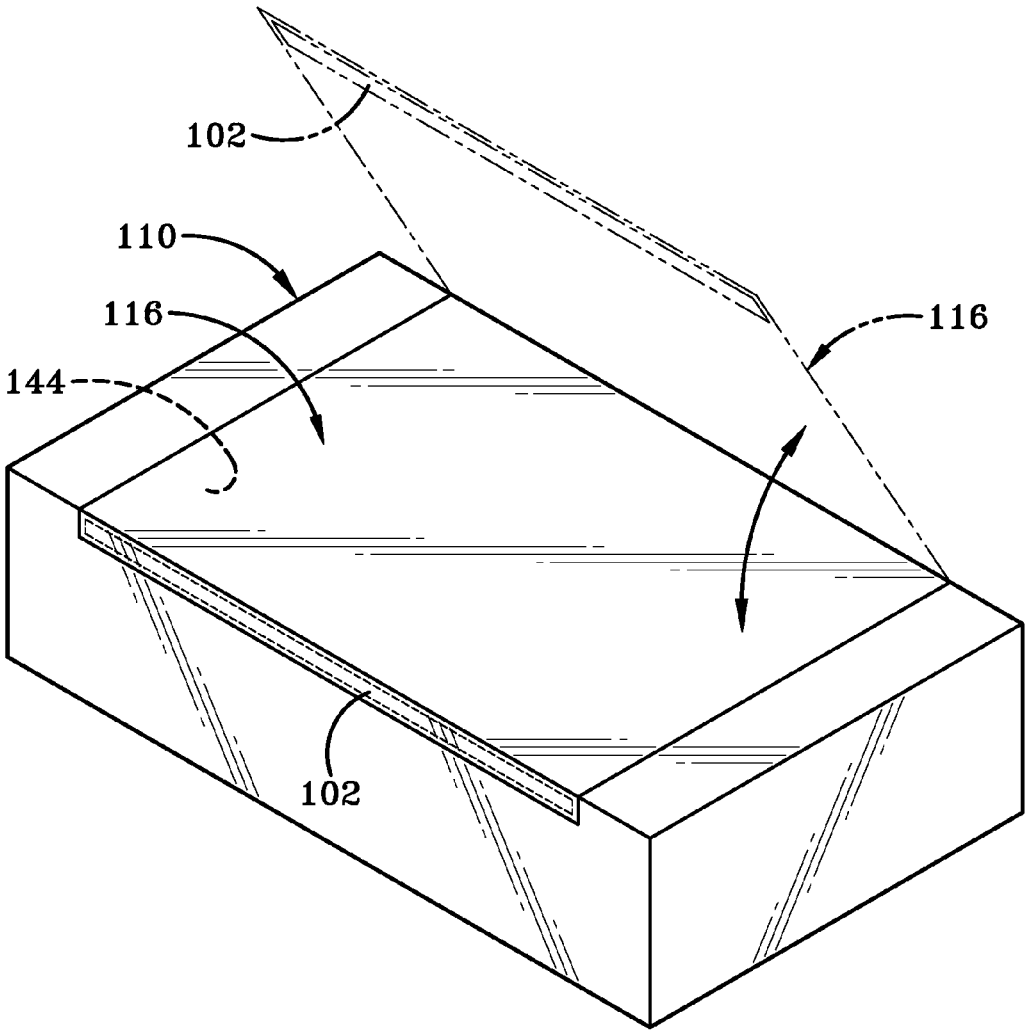
FIG. 7 is a perspective view of a second embodiment of the supplemental insulating cover.
Figure 8:
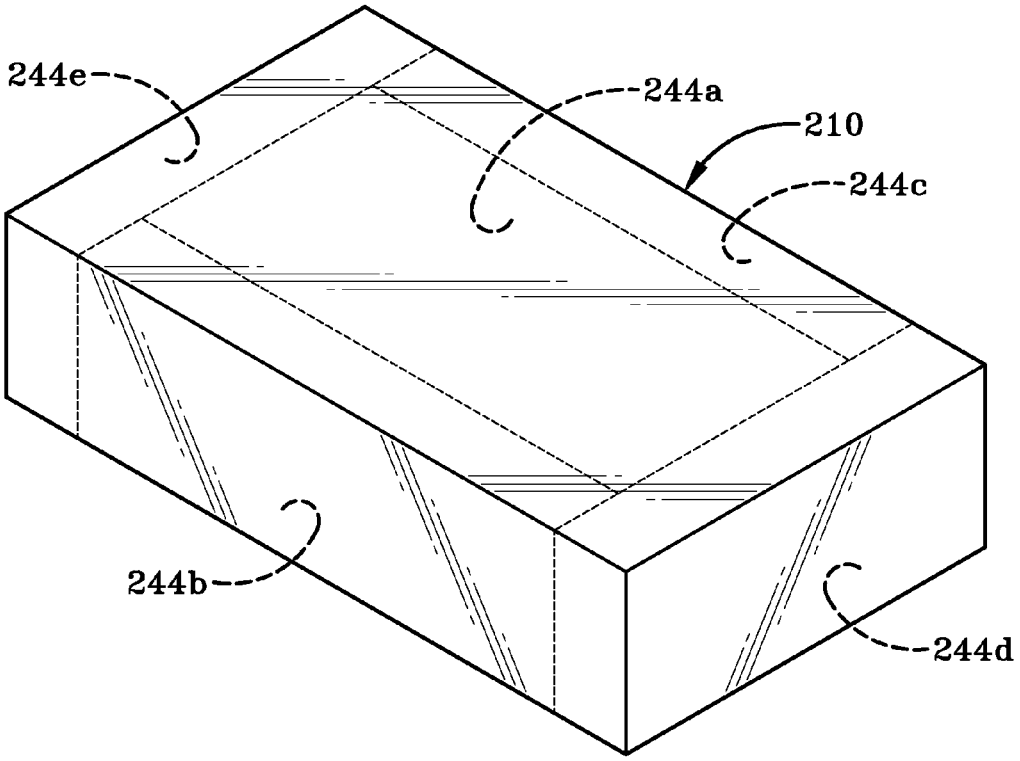
FIG. 8 is a perspective view of a third embodiment of the supplemental insulating cover.

As shown throughout the Figures, an insulation system 1 comprises a supplemental insulating cover shown as 10 in FIGS. 1-6; shown as 110 in FIG. 7; and shown as 210 in FIG. 8. System 1 further comprises a generally rigid attic insulating and sealing member 12 and an attic opening 14. Supplemental cover 10 receives a portion of member 12 therein to cover generally rigid member 12 when member 12 is in a sealing position atop attic opening 14. Cover 10 is configured to be filled with insulation 46.

With primary reference to FIGS. 1-6, cover 10 includes a top panel 16 spaced apart and generally parallel to a bottom panel 26 that defines a vertical direction therebetween. Top panel 16 faces vertically upward and bottom panel 26 faces vertically downward. Cover 10 includes a first sidewall 18 spaced apart and preferably generally parallel to a second sidewall 20 that defines a lateral direction therebetween. Cover 10 includes a first endwall 22 spaced apart and preferably generally parallel to a second endwall 24 that defines a longitudinal direction therebetween.

Endwalls 22, 24 intersect sidewalls 18, 20 in a generally perpendicular manner to define a generally box-like structure. Top panel 16 and bottom panel 26 connect to sidewalls 18, 20 and endwalls 22, 24 to respectively define the top and bottom of the box-like structure. Cover 10 defines a fillable and hollow chamber 44 therein. While it is preferable in this embodiment that sidewalls 18, 20 are generally parallel, there may be instances where sidewalls 18, 20 are not parallel. For example, some generally rigid members 12 known to exist in the art are not rectangular in shape, they are trapezoidal. If generally rigid member 12 is trapezoidal, then clearly sidewalls 18, 20 will not be parallel either to allow cover 10 to properly fit over member 12.

Cover 10 is preferably a substantially non-rigid and at least semi-flexible structure, yet there may be some semi-rigid components as described below. In one particular embodiment, top and bottom panels 16, 26, sidewalls 18, 20 and endwalls 22, 24 are constructed of a polymer based flexible material such as an LDPE (polyethylene film). Alternatively, a fabric or non-woven fabric (NWF) could be used to construct the top and bottom panels 16, 26, sidewalls 18, 20 and endwalls 22, 24 that define cover 10. Further, while it is preferable that top and bottom panels 16, 26, sidewalls 18, 20 and endwalls 22, 24 are flexible, it is clearly possible that top and bottom panels 16, 26, sidewalls 18, 20 and endwalls 22, 24 may be semi-flexible or generally rigid to define chamber 44. The material thickness of top and bottom panels 16, 26, sidewalls 18, 20 and endwalls 22, 24 of cover 10 is sufficient to hold insulation 46 in chamber 44 without adding unnecessary weight of system 1 by creating an unnecessarily thick cover 10. Seams (unnumbered) extending along the intersection of respective panels and walls of cover 10 are formed using a heat-seaming device (not shown) to seal overlapping segments of adjoining panels, however it is clearly contemplated that other manners of forming seams are entirely possible as one having skill in the art would understand. If cover 10 is a NWF, the seams could need to be stitched or heat-seamed or formed in another manner as one having skill in the art would understand.

In one exemplary embodiment for covering an attic staircase opening, supplemental cover 10 has the following non-limiting dimensions when filled with insulation 46: a longitudinal length measured endwall 22 to endwall 24 from about 70 to about 85 inches; a lateral width measure sidewall 18 to sidewall 20 from about 40 to about 50 inches; and a vertical height measured top panel 16 to bottom panel 26 from about 15 to about 25 inches.

Figure 1:
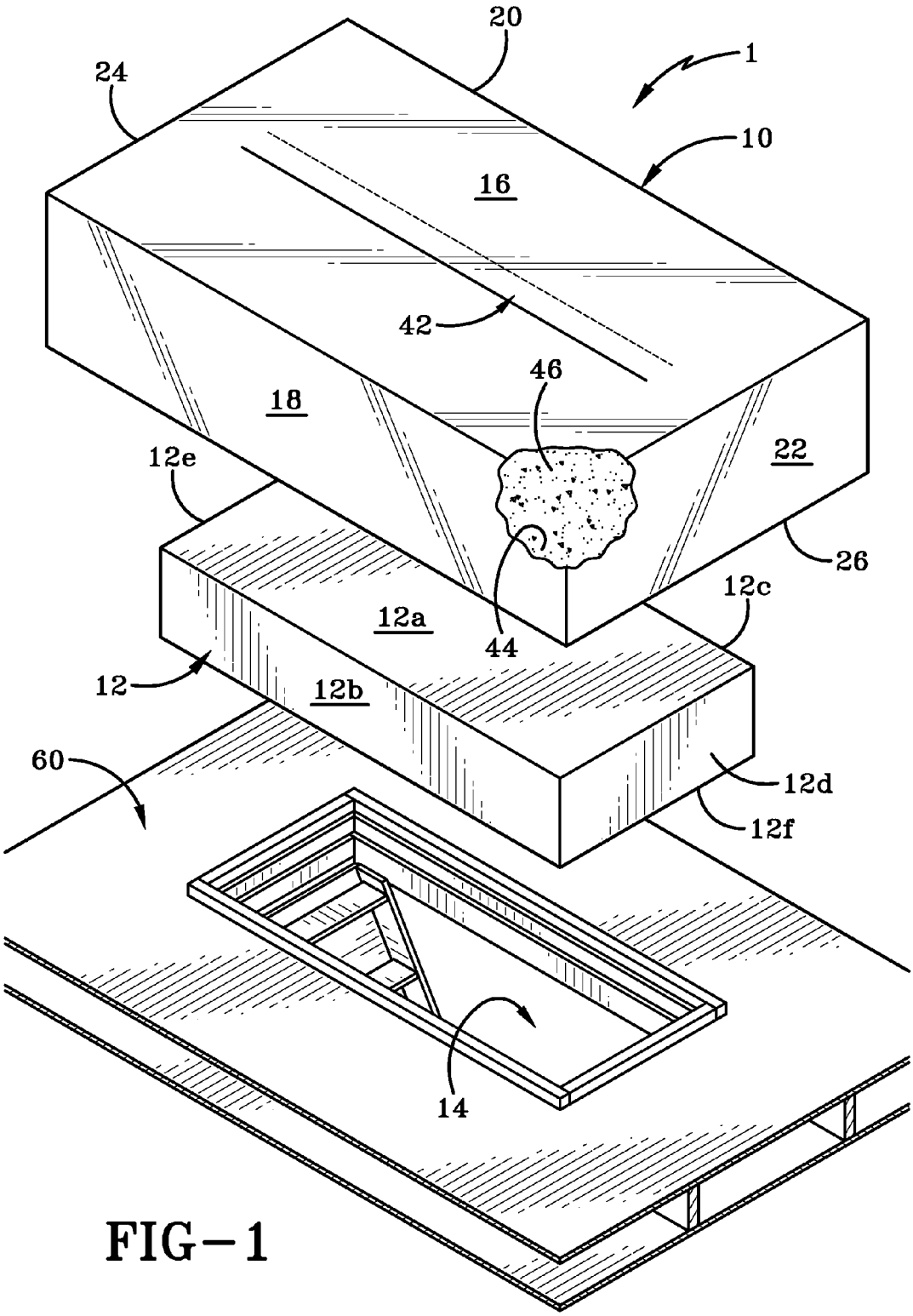
FIG. 1 is an exploded perspective view of an insulation system including a supplemental insulating cover and a rigid attic insulating and sealing member for insulating the space above an attic opening, the supplemental cover depicts a broken away corner detailing the insulating material contained within the cover.
Figure 2:
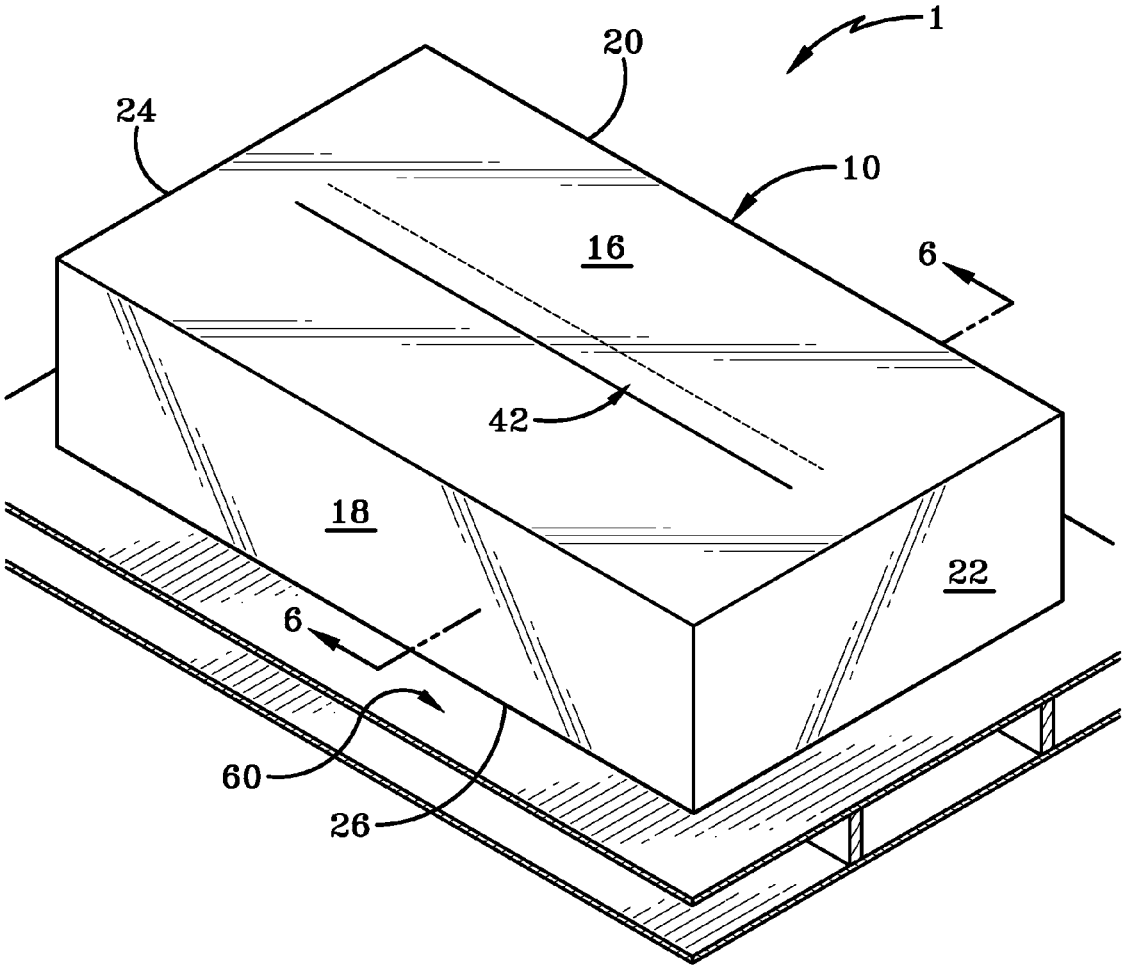
FIG. 2 is an assembled perspective view of the insulation system.
Figure 3:
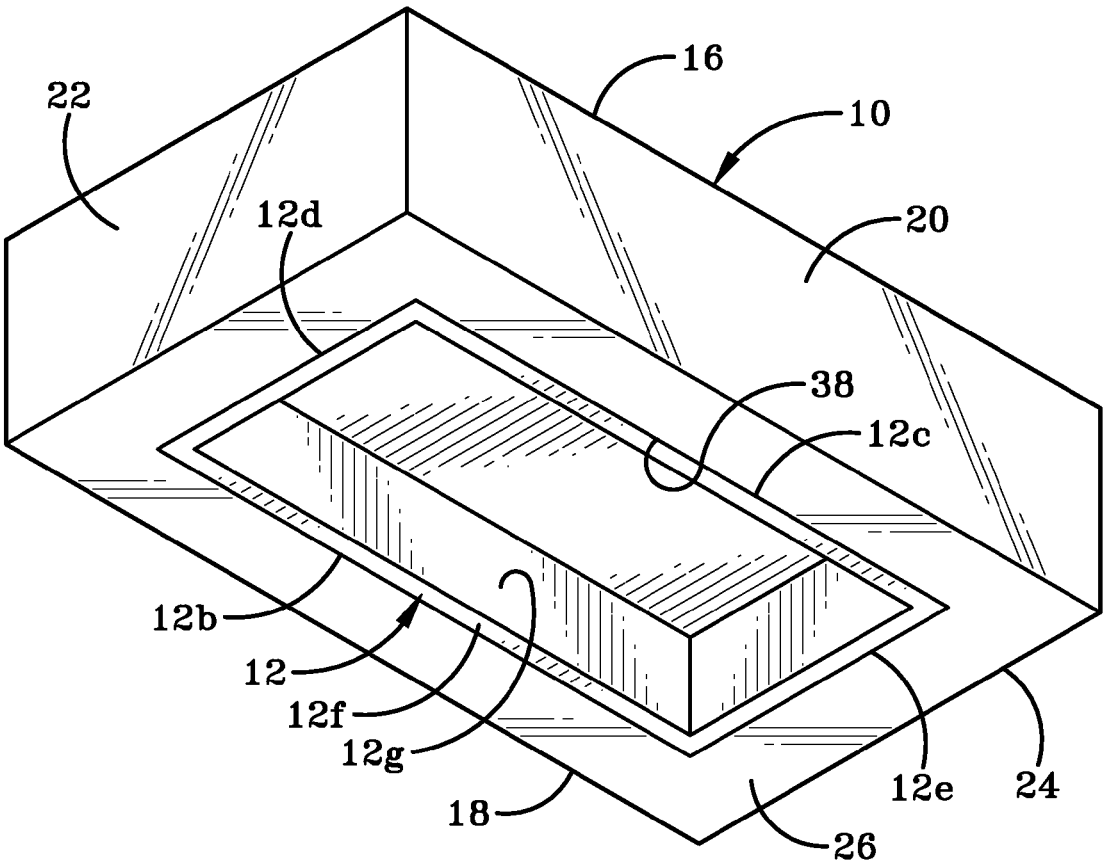
FIG. 3 is a bottom perspective view of the supplemental insulating cover receiving and covering the rigid attic insulating and sealing member.
Figure 4:
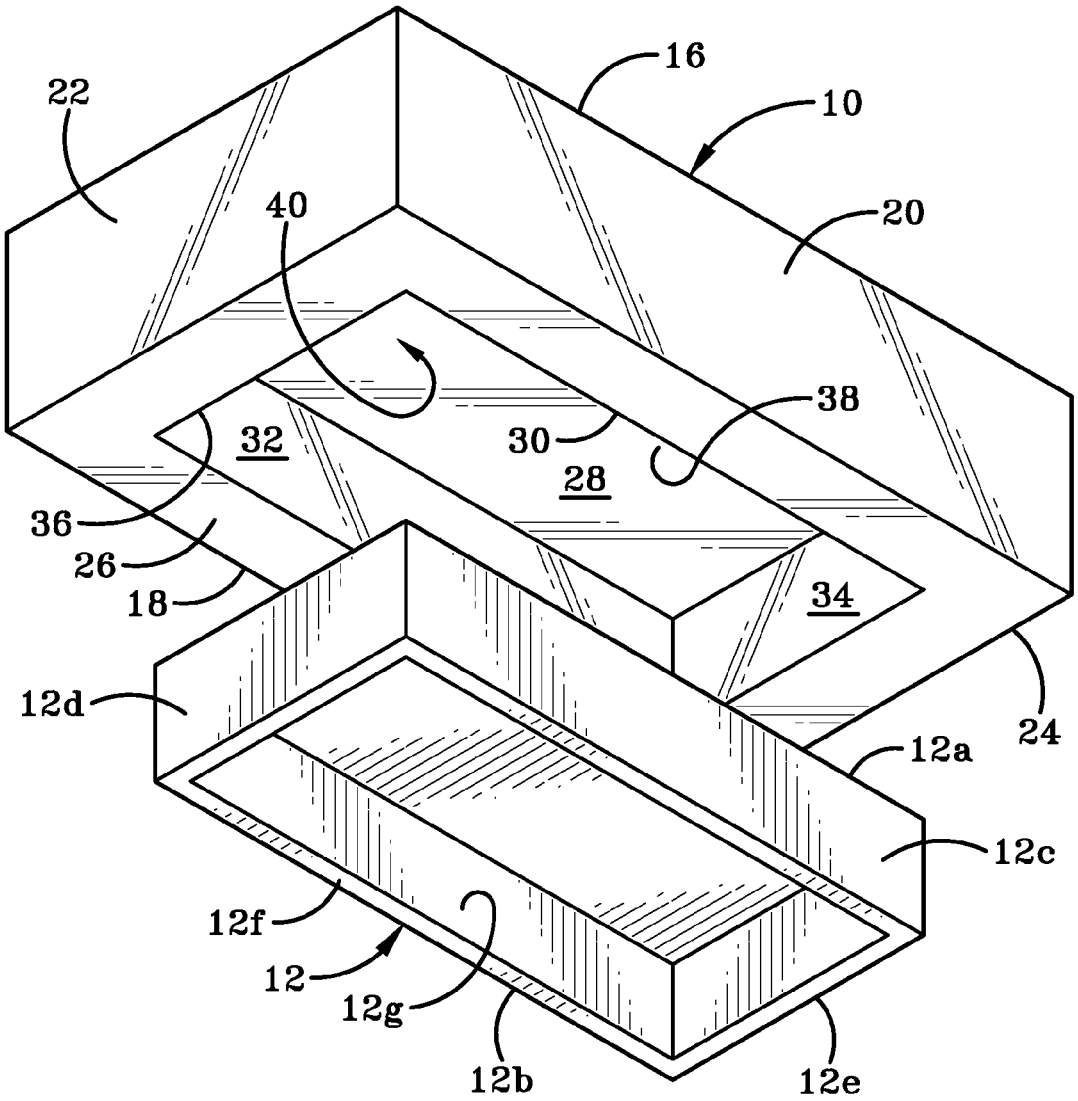
FIG. 4 is an exploded bottom perspective view of the supplemental insulating cover and the rigid attic insulating and sealing member.

As shown in FIG. 4, cover 10 further includes walls that extend inwardly into interior chamber 44 from bottom panel 26 to define a cavity 40. Namely, two longitudinally extending inner sidewalls 30, 32 are spaced apart between two laterally extending inner endwalls 34, 36. Inner sidewall 30 is generally parallel to sidewall 20 defining a portion of chamber 44 therebetween. Inner sidewall 32 is generally parallel to sidewall 18 defining a portion of chamber 44 therebetween. Inner endwall 34 is generally parallel to endwall 24 defining a portion of chamber 44 therebetween. Inner endwall 36 is generally parallel to endwall 22 defining a portion of chamber 44 therebetween. An upper inner panel 28 defines the top of cavity 40. Upper inner panel 28 is generally parallel with top panel 16 defining a portion of chamber 44 therebetween. By way of non-limiting example, the outer surfaces of inner sidewalls 30, 32, inner endwalls 34, 36, and upper inner panel 28 on cover 10 define cavity 40.

With primary reference to FIG. 5, a slit or passage opening 42 extends along top panel 16. Slit 42 is configured to permit access into and egress out of chamber 44 (FIG. 6). Slit 42 preferably includes overlapping segments formed in panel 16. The overlapping segments of passage 42 may have securing members affixed thereto, such as adhesive or hook-and-loop closures to retain the overlapping segments together. Alternatively, slit 42 may be closed by having zipper (not shown) attached to the respective edges that define slit 42. Furthermore, while reference is made to slit 42 being formed by overlapping segments formed in panel 16, it is to be clearly understood that the slit 42 may be located in any panel 16, 26, 28 or any sidewall 18, 20, 30, 32, or any endwall 22, 24, 34, 36 which would give an operator access to interior chamber 44.

Chamber 44 may be filled with blown insulation 46 by inserting hose 48 through slit 42. Alternatively, a non-blowable insulation 46, such as fiberglass insulation as understood in the art, may be inserted through slit 42 into chamber 44 by hand. Chamber 44 may have a depth configured to fit full sized R-30 fiberglass insulation. By way of non-limiting example, interior chamber 44 has a depth of about nine inches measured from top panel 16 to bottom panel 26. The nine inch depth is configured to accommodate R-30 fiberglass insulation, however the depth could vary to accommodate alternatively R-valued fiberglass insulations which would have associated thicknesses.

Insulation 46 is a conventionally acceptable form of attic insulation. Some non-limiting examples of insulation that may be used are fiberglass, mineral wool, plastic fiber, natural fiber, conventionally known batting, foam or foam board, cellulose, conventionally understood expanding insulation, or any variety of combinations thereof. Alternatively, if a non-blown insulation is used, such as a blanket or roll type, insulation 46 may be inserted into chamber 46 through slit 42 by hand. A non-limiting example of insulation 46 that may be used in system 1 is a R-30 fiberglass unfaced continuous roll, commercially known as EcoTouch™ available for sale by Owens Coming Corporation of Toledo, Ohio.

In exemplary embodiments, about twenty pounds of insulation 46 is used to fill chamber 44 by inserting the insulation 46 through slit 42. When using roll insulation 16 as described above, it is contemplated that the roll will be cut into various segments so the cut insulation segments can be laid within chamber 44. For example, a first set of two cut segments of roll insulation 46 have a width of about 15 inches and a length of about 62 inches and a thickness of about 9 inches. One of these two segments from the first set is disposed between a sidewall 18 and inner wall 32 within the chamber 44. The second of these two segments from the first set is disposed between sidewall 20 and inner sidewall 30 within the chamber 44. A second set of two cut insulation segments of roll insulation 46 have a width of about 15 inches and a length of about 46 inches and a thickness of about 9 inches. One of these two segments from the second set is disposed laterally between endwall 22 and inner endwall 36 within chamber 44. The second of these two segments from the second set is disposed between endwall 24 and inner endwall 34 within chamber 44. A third set of three cut insulation segments of roll insulation 46 have a width of about 15 inches and a length of about 78 inches and a thickness of about 9 inches. Each of the cut segments are disposed longitudinally side-to-side and positioned below top panel 16 and above the first set, the second set, and the upper inner panel 28 within chamber 44. When arranged in the above described manner, flexible cover 10 retains the shape of the laid insulation 46 segments and retains the shape of insulating and sealing member 12 when covering the insulating and sealing member 12.

As depicted in FIG. 4 and FIG. 6, the bottom edges of inner sidewalls 30, 32, and inner endwalls 34, 36 define a cavity opening 38. The bottom edges defining opening 38 are spaced laterally and longitudinally inward of the bottom edges of sidewalls 18, 20 and endwalls 22, 24. Cavity opening 38 is in communication with cavity 40. Cavity 40 extends from opening 38 to upper inner panel 28. Upper inner panel 28 is positioned at a height above bottom panel 26 and vertically below top panel 16 when viewed from the side. Upper inner panel 28 and inner sidewalls 30, 32, and inner endwalls 34, 36 are also preferably made of a non-rigid material similar to sidewalls 18, 20 and endwalls 22, 24. However, it is clearly possible that upper inner panel 28 and inner sidewalls 30, 32, and inner endwalls 34, 36 may be generally rigid to define cavity 40.

With continued reference to FIG. 6, when supplemental cover 10 is placed above opening 14, cavity 40 is to the left of inner sidewall 30 and chamber 44 is to the right of inner sidewall 30. Cavity 40 is to the right of inner sidewall 32 and chamber 44 is to the left of inner sidewall 32. Cavity 40 is below upper inner panel 28 and chamber 44 is above upper inner panel 28. When viewed in cross section (FIG. 6) cover 10 has an inverted U-shaped configuration having a thickness, wherein the representative thickness is defined by chamber 44 and the space defined between the legs of the U-shape is cavity 40.

As shown throughout the Figures, supplemental cover 10 receives generally rigid insulating and sealing member 12 at least partially in cavity 40. Rigid member 12 is also a box like structure configured to engage the attic floor 60 above attic opening 14. Rigid member 12 includes a generally rigid top panel 12*a*, sidewalls 12*b*, 12*c*, and endwalls 12*d*, 12*e*, and a bottom wall 12*f*. The rigid member walls define a rigid member cavity 12*g*. In one non-limiting embodiment, generally rigid member cavity 12*g* receives the attic staircase therein when the staircase is in a closed position. Alternative examples may be free of a staircase, such as when the supplemental cover 10 is placed atop member 12 placed above an attic scuttle opening.

In the example embodiment, when in the assembled position (FIG. 2 and FIG. 6) top panel 12*a* is closely adjacent upper inner panel 28. Similarly, sidewalls 12*b*, 12*c*, are closely adjacent inner sidewalls 32, 30, respectively. Additionally, endwalls 12*d*, 12*e* are closely adjacent inner endwalls 36, 34, respectively. In one embodiment, the respective walls engage each other via a frictional interference fit, however other conventionally understood ways of attaching member 12 within cavity 40 of supplemental cover 10, such as via adhesive or hook-and-loop securing members, are contemplated. In one preferred example, member 12 is secured within cavity 40 of supplemental cover 10 by double-sided adhesive tape.

Elements of insulating and sealing member 12 are herein described relative to elements on supplemental cover 10. When viewed in cross section (FIG. 6), top panel 12*a* is below upper inner panel 28 and at a height above bottom panel 26. Top panel 12*a* is positioned inwardly within cavity 40 from inner sidewalls 30, 32, and inner endwalls 34, 36. Insulating and sealing member 12 has an inverted U-shaped configuration when viewed in cross section that stackingly nests within cavity 40. Top panel 12*a* on sealing member 12 is positioned generally directly above the access opening in the attic floor and in one particular example is positioned directly above a folded articulable attic access ladder.

By way of non-limiting example, rigid insulating and sealing member 12 may be a Therma-Dome® commercially available for sale by Yankee Insulation Products, LLC of New Boston, N.H. Although the Therma-Dome®, is the preferred rigid member 12, clearly other commercially available rigid members configured to seal an attic opening 14 may be used.

Commercially available rigid insulating members are ordinarily lined with an insulating foil, which gives the generally rigid sealing member 12 an insulation value of about R-13. However, typically, many states set forth guidelines for a newly constructed or newly renovated attic to have an insulation value of about R-30, some states, such as Massachusetts, for example, have released weatherization assistance programs and technical manuals which suggest that attic insulation have an insulation value of at least R-38. The MASSACHUSETTS WEATHERIZATION ASSISTANCE PROGRAM TECHNICAL MANUAL recommends using a Therma-Dome® or equivalent (i.e., generally rigid insulating and sealing member 12) to be used whenever possible. See Page 60 of the MASSACHUSETTS WEATHERIZATION ASSISTANCE PROGRAM TECHNICAL MANUAL, the entirety of which is hereby incorporated by reference as if fully re-written herein and a copy of which may be obtained at https://masscap.files.wordpress.com/2010/04/wap-technical-manual-2008.pdf at the time of filing this disclosure.

Thus, when the state codes require or guidelines suggest a certain R-value for the attic, supplemental cover 10 has an R-value to meet those thresholds in order to ensure the system 1 R-value is similar to a surrounding attic floor R-value. In the non-limiting example stated above, if the surrounding attic R-value is R-38, supplemental cover 10 is filled with insulation so insulation system 1 has a resultant R-38 insulating value as well.

With continued reference to FIG. 6, an exemplary use relates to an attic opening 14 with a staircase, however it is understood that other attic openings may be covered with cover 10 atop member 12. Attic opening 14 is configured to receive a convertible and folding attic stair case therethrough. The attic opening 14 is defined by a conventional attic passageway frame to permit a homeowner access to the attic. A pull-down foldable ladder (unnumbered) provides access to the attic so a homeowner can climb the staircase and stand on the attic floor 60. The stairwell to the attic is provided with a spring-loaded closure which is pivotally mounted at one end. The foldable ladder is mounted to the top side of the closure and such offers support to the ladder when it is unfolded, the foot of the ladder resting on the floor of a hallway or a room. The closure is provided on the bottom side with a rope or other means for pulling the closure downwardly so that the ladder can be unfolded to provide access to the attic. The closure is generally located between two joists whereby the ladder in its folded mode is located between the joists.

With primary reference to FIG. 7, supplemental cover 110 provides an alternative way of permitting access to the chamber 144 for filling with insulation. Cover 110 includes a flap or door 116 selectively moveable between an open and closed position. As shown in FIG. 7, door 116 may be pivotably opened about one side of door 116 via a pivotal connection to a sidewall. Door 116 may be securely closed by a securing member 102 when in the closed position. Securing member 102 is preferably hook-and-loop closures to retain the overlapping segments of securing member 102 together. Alternatively, securing member 102 may be closed by having zipper (not shown) attached or through the use of adhesive.

With primary reference to FIG. 8, cover 210 includes a plurality of interior compartments or segmented chambers 244*a*, 244*b*, 244*c*, 244*d*, and 244*e*. The segmented chambers 244*a*, 244*b*, 244*c*, 244*d*, and 244*e* permit a user to selectively fill and insulate the respective chambers. This is beneficial as there may be a scenario where one side of cover 210 is disposed closely adjacent to an attic wall (not shown) and a chamber may be selectively left empty to fit the space. Segmented chamber 244*a* is positioned below the top panel and above the upper inner panel. Segmented chambers 244*b* and 244*c* are positioned opposite each other and extend longitudinally along each side of the inner walls that define cavity 40. Segmented chambers 244*d* and 244*e* are positioned opposite each other and extend laterally along each side of the inner walls that define cavity 40. Segmented chambers 244*a*, 244*b*, 244*c*, 244*d*, and 244*e* may be filled with insulation during construction or assembly of cover 210.

Additional components may be included to further accomplish the purpose of system 1. By way of non-limiting example, a shape retaining member (not shown), like a belt or even a skeleton frame, may be included with system 1 to surround and reinforce cover 10 to retain the intended shape of cover 10 when it is filled with insulation.

In accordance with one exemplary embodiment of the present invention, supplemental cover 10 is designed and configured to supplement and raise the total insulation value of the insulating ability of an existing attic insulating and sealing rigid member 12. Insulating and sealing member 12 atop opening 40 with a pull-down attic staircase ordinarily has an approximate R-13 insulative value. Cover 10 allows the homeowner to raise the R-value to R-30 or higher by covering the existing insulating and sealing member 12 and placing additional insulation 46 on all outside surfaces (sides, ends, and top) of the insulating and sealing member 12 within chamber 44 of supplemental cover 10. The combination of supplemental cover 10 with insulating and sealing member 12 will allow the insulating and sealing member 12 (which has a relatively low R-value and is insufficient to meet some building codes by itself) to be used in applications that require compliance with building codes that specify minimum R-value insulation over attic access that exceeds the R-value of the insulating and sealing member 12 by itself. Insulating and sealing member 12 includes a first insulating R-value and supplemental cover 10 for placing atop the sealing member includes a second insulating R-value larger than the first insulating R-value of insulating and sealing member 12. The first and second insulating R-values combine to achieve the desired R-value of system 1. In one example, a first insulating R-value of the insulating and sealing member 12 is less than about R-13 and a second insulating R-value of the supplemental cover 10 is greater than about R-30, achieving a cumulative insulative R-value of at least R-40 which meets most state building codes at the time of this disclosure.

In one particular embodiment, system 1 including cover 10 capping sealing member 12 has an insulating R-value that is at least R-38. In another example, system 1 may have a R-value (collectively cover 10 plus insulating and sealing member 12) as high as an R-45 rating, which is a significant improvement over the R-13 rating of member 12 alone. Notably, cover 10 of system 1 is preferably not a stand-alone solution to insulating an attic opening, however alternatively contemplated embodiments may be standalone devices. Further, cover 10 can be used to supplement the insulating value of other attic cover units, such as by way of non-limiting examples, a whole-house attic fan cover or an attic scuttle hole access cover.

In operation, a user must first prepare and ensure the attic floor 60 is level to accommodate rigid member 12. Rigid member 12 is placed on attic floor 60 such that bottom wall 12*f* engages the floor 60 and top panel 12*a* is upwardly facing. Cover 10 is placed over the top panel 12*a* of rigid attic insulating and sealing member 12, or over the Therma-Dome®. The top panel 12*a* of member 12 is aligned with cavity opening 38. Then a user applies a downward force to cover 10 so that member fits into cavity 40. The sidewalls 12*b-e* frictionally engage inner sidewalls 30, 32, and inner endwalls 34, 36 that define cavity 40. The rigidity of member 12 provides the base structure for the flexible embodiment of cover 10. In some embodiments, prior to fitting the cover 10 over member 12, an adhesive may be exposed so cover 10 sticks to member 12 when member 12 is nested within cavity 40.

Then a user fills cover 10 with insulation 46. When using roll insulation, a user may cut segments of the roll insulation to a desired length. As described above, a first set of two cut segments of roll insulation 46 have a width of about 15 inches and a length of about 62 inches. One of these two segments from the first set is inserted through slit 42 and maneuvered such that it is disposed between a sidewall 18 and inner wall 32 within the chamber 44. The second of these two segments from the first set is inserted through slit 42 and maneuvered such that it is disposed between sidewall 20 and inner wall 30 within the chamber 44. A second set of two cut insulation segments of roll insulation 46 have a width of about 15 inches and a length of about 46 inches. One of these two segments from the second set is inserted through slit 42 and maneuvered such that it is disposed laterally between endwall 22 and inner wall 36 within chamber 44. The second of these two segments from the second set inserted through slit 42 and maneuvered such that it is disposed between endwall 24 and inner wall 34 within chamber 44. A third set of three cut insulation segments of roll insulation 46 have a width of about 15 inches and a length of about 78 inches. Each of the cut segments are inserted through slit 42 and maneuvered such that they are disposed longitudinally side-to-side and positioned below top panel 16 and above the first set, the second set, and the upper inner panel 28 within chamber 44. Alternatively, when using blown insulation 46, a user may insert a hose 48 through slit 42 and pump insulation into chamber until full.

Once supplemental cover 10 has been filled with insulation, the assembled system 1 is placed over the attic opening 14. Bottom wall 12*f* engages attic floor 60 to create an air tight seal.

It is noteworthy that the present invention can be used to raise the insulative R-value of any space above an attic opening equal to that of the attic floor, not just a ladder for the attic access opening. The present invention may be broadly used with scuttle openings and any other openings to the attic regardless of their location, such as a side opening or a roof hatch.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the example embodiment of the invention are an example and the invention is not limited to the exact details shown or described.

What is claimed:

1. A supplemental insulating cover to insulate an area around a standalone insulating and sealing member the supplemental cover comprising:

a first outer endwall having opposed inner and outer surfaces;

a second outer endwall having opposed inner and outer surfaces, the second outer endwall spaced from the first outer endwall and wherein the inner surface of the second outer endwall faces the inner surface of the first outer endwall;

the first and second outer endwalls defining a longitudinal direction therebetween;

a first outer sidewall having opposed inner and outer surfaces, the first outer sidewall extending longitudinally between the first and second outer endwalls;

a second outer sidewall having opposed inner and outer surfaces, the second outer sidewall extending longitudinally between the first and second outer endwalls spaced from the first outer sidewall and wherein the inner surface of the second outer sidewall faces the inner surface of the first outer sidewall;

the first and second outer sidewalls defining a lateral direction therebetween;

a top panel having a downwardly facing inner surface and an upwardly facing outer surface;

a bottom panel having an upwardly facing inner surface and a downwardly facing outer surface, the bottom panel defining a cavity opening;

the top panel and the bottom panel defining a vertical direction therebetween;

a first inner endwall extending vertically upward from the cavity opening and terminating below the top panel, and the first inner endwall spaced from the first outer endwall and extending laterally between the first and second outer sidewalls, the first inner endwall having opposed inner and outer surfaces, wherein the inner surface of the first inner endwall faces the inner surface of the first outer endwall;

a second inner endwall extending vertically upward from the cavity opening and terminating below the to panel, and the second inner endwall spaced from the second outer endwall extending laterally between the first and second outer sidewalls, the second inner endwall having opposed inner and outer surfaces, wherein the inner surface of the second inner endwall faces the inner surface of the second outer endwall;

a first inner sidewall extending vertically upward from the cavity opening and terminating below the to panel, and the first inner sidewall spaced from the first outer sidewall and extending longitudinally between the first and second outer endwalls, the first inner sidewall having opposed inner and outer surfaces, wherein the inner surface of the first inner sidewall faces the inner surface of the first outer sidewall;

a second inner sidewall extending vertically upward from the cavity opening and terminating below the top panel, and the second inner sidewall spaced from the second outer sidewall and extending longitudinally between the first and second outer endwalls, the second inner sidewall having opposed inner and outer surfaces, wherein the inner surface of the second inner sidewall faces the inner surface of the second outer sidewall;

wherein the inner surfaces of the first and second outer endwalls, the first and second outer sidewalls, the top and bottom panels, the first and second inner endwalls, and the first and second inner sidewalls define an interior chamber;

insulation disposed in the interior chamber having a first R-value and the insulating and sealing member having a second R-value, wherein the first and second R-values are each greater than R-5, wherein the first R-value is greater than the second R-value, and wherein a cumulative R-value summing the first and second R-values is at least R-38;

wherein the outer surfaces of the first and second inner endwalls, and the outer surfaces of the first and second inner sidewalls define a cavity, the cavity adapted to receive the insulating and sealing member therein, wherein the insulating and sealing member is rigid and wherein the first and second inner endwalls and the first and second inner sidewalls are reliant on the insulating and sealing member for shape; and wherein the first and second outer endwalls, the first and second outer sidewalls, and the top and bottom panels are reliant on the insulation for shape.

2. The supplemental insulating cover of claim 1, wherein a portion of the interior chamber defined between the first outer sidewall the first inner sidewall has a width of 9 inches and wherein the insulation is cut from a roll having a width of 9 inches to fill the portion of the interior cavity between the first outer sidewall and the first inner sidewall.

3. The supplemental insulating cover of claim 1, wherein a portion of the interior chamber defined between the first outer endwall and the first inner endwall has a length 9 inches and wherein the insulation is cut from a roll having a width of 9 inches to fill the portion of the interior cavity when laid laterally between the first outer endwall and the first inner endwall.

4. The supplemental insulating cover of claim 1, wherein the insulation filling the interior chamber is a consistent depth from the bottom panel to the to panel between the first outer sidewall and the first inner sidewall, and further comprising:

a longitudinal length measured from the first outer endwall to the second outer endwall in a range from 70 inches to 85 inches;

a lateral width measured from the first outer sidewall to the second outer sidewall in a range from 40 inches to 50 inches; and a vertical height measured from the bottom panel to the top panel in a range from 15 inches to 25 inches.

5. The supplemental insulating cover of claim 1, wherein the insulation inside the interior chamber is evenly distributed over the top and each of the four sides of the insulating and sealing member.

6. The supplemental insulating cover of claim 5, wherein the first and second outer sidewalls, the first and second outer endwalls, the top panel, and the bottom panel are flexible low density polyethylene (LDPE) film.

7. The supplemental insulating cover of claim 5, wherein the first and second outer sidewalls, the first and second outer endwalls, the top panel, and the bottom panel are flexible fabric.

8. The supplemental insulating cover of claim 1, further comprising:

a slit formed in the top panel providing access into the interior chamber.

9. The supplemental insulating cover of claim 1, wherein the supplemental cover has an inverted U-shape configuration in cross section.

10. The supplemental insulating cover of claim 1, wherein the insulation is full size R-30 insulation cut from an unfaced continuous roll.

11. The supplemental insulating cover of claim 1, further comprising:

a lid selectively permitting access to the interior chamber for filling with insulation.

12. The supplemental insulating cover of claim 1, wherein the interior chamber is divided into a plurality of segmented interior chambers.

13. An insulating system within an attic above an opening in the attic floor, the system comprising:

a rigid attic insulating and sealing member releasably connected to the attic floor to seal the opening and including a first insulating R-value; and a supplemental cover around and atop the insulating and sealing member including a second insulating R-value larger than the first insulating R-value, wherein the supplemental cover is reliant in shape on the rigid attic insulating and sealing member.

14. The insulating system within an attic of claim 13, further comprising:

wherein the supplemental cover includes a flexible top panel and a flexible bottom panel partially defining an interior chamber therebetween, wherein insulation is disposed within the interior chamber; and wherein the bottom panel defines a cavity opening shaped complementary to the rigid attic insulating and sealing member, and the insulating and sealing member at least partially disposed through the cavity opening.

15. The insulating system within an attic of claim 13, further comprising:

wherein the first insulating R-value is less than R-20;

wherein the second insulating R-value is greater than R-20; and a total system R-value found by summing the first insulating R-value and the second insulating R-value, wherein the total system R-value is at least R-38.

16. The insulating system within an attic of claim 13, wherein the total system R-value is similar to a surrounding insulating R-value of insulation laid on the attic floor.

17. The insulating system within an attic of claim 15, wherein the supplemental cover releasably caps the insulating and sealing member and a bottom panel contacts the attic floor and the insulation within the interior chamber having an equal width above the bottom panel on each respective side of the cavity opening when viewed in cross section.

18. The insulating system within an attic of claim 13, wherein the insulating and sealing member has a foil lining and extends upwardly from the floor entirely above the opening in the attic floor and wherein the supplemental cover is entirely fabricated from one of (a) a flexible polymer and (b) a flexible fabric.

19. The insulating system within an attic of claim 13, further comprising:

a folded articulated attic staircase attached to an attic pull-down door in the opening in the attic floor, wherein the insulating and sealing member extends over the folded staircase;

a nesting relationship between the supplemental cover and the insulating and sealing member, wherein the insulating and sealing member nests within an upwardly extending cavity defined by the supplemental cover; and a sealing position wherein the supplemental cover is around and atop the insulating and sealing member resting above the folded attic staircase to seal and insulate space above the opening in the attic floor.

20. An insulation system comprising:

an attic having a floor defining an attic opening;

a foldable staircase connected to a door, the staircase at least partially disposed in the attic opening in a closed position;

a standalone insulating and sealing member engaging the attic floor and extending upwardly into the attic from a releasably sealed connection with the floor entirely above the attic opening, the insulating and sealing member having an inverted box configuration including rigid sidewalls and rigid endwalls lined with foil defining a first cavity receiving a portion of the foldable staircase, the insulating and sealing member having a first R-value less than R-20;

a supplemental cover insulating an area around and above the standalone insulating and sealing member, the supplemental cover releasably contacting the attic floor and extending over the attic opening, the supplemental cover including:

a flexible first outer endwall having opposed inner and outer surfaces;

a flexible second outer endwall having opposed inner and outer surfaces, the second outer endwall spaced parallel from the first outer endwall and wherein the inner surface of the second outer endwall faces the inner surface of the first outer endwall;

the first and second outer endwalls defining a longitudinal direction therebetween;

a flexible first outer sidewall having opposed inner and outer surfaces, the first outer sidewall extending longitudinally between the first and second outer endwalls;

a flexible second outer sidewall having opposed inner and outer surfaces, the second outer sidewall extending longitudinally between the first and second outer endwalls spaced parallel from the first outer sidewall and wherein the inner surface of the second outer sidewall faces the inner surface of the first outer sidewall;

the first and second outer sidewalls defining a lateral direction therebetween;

a flexible top panel having a downwardly facing inner surface and an upwardly facing outer surface;

a flexible bottom panel having an upwardly facing inner surface and a downwardly facing outer surface, the bottom panel defining a cavity opening;

the top panel and the bottom panel defining a vertical direction therebetween;

a flexible first inner endwall extending vertically upward from the cavity opening and terminating below the top panel, and the first inner endwall spaced parallel from the first outer endwall and extending laterally entirely between the first and second outer sidewalls, the first inner endwall having opposed inner and outer surfaces, wherein the inner surface of the first inner endwall faces the inner surface of the first outer endwall;

a flexible second inner endwall extending vertically upward from the cavity opening and terminating below the top panel, and the second inner endwall spaced parallel from the second outer endwall extending laterally entirely between the first and second outer sidewalls, the second inner endwall having opposed inner and outer surfaces, wherein the inner surface of the second inner endwall faces the inner surface of the second outer endwall;

a flexible first inner sidewall extending vertically upward from the cavity opening and terminating below the top panel, and the first inner sidewall spaced parallel from the first outer sidewall and extending longitudinally between the first and second outer endwalls, the first inner sidewall having opposed inner and outer surfaces, wherein the inner surface of the first inner sidewall faces the inner surface of the first outer sidewall;

a flexible second inner sidewall extending vertically upward from the cavity opening and terminating below the top panel, and the second inner sidewall spaced parallel from the second outer sidewall and extending longitudinally between the first and second outer endwalls, the second inner sidewall having opposed inner and outer surfaces, wherein the inner surface of the second inner sidewall faces the inner surface of the second outer sidewall;

wherein the inner surfaces of the first and second outer endwalls, the first and second outer sidewalls, the top and bottom panels, the first and second inner endwalls, and the first and second inner sidewalls define an interior chamber;

wherein the outer surfaces of the first and second inner endwalls, and the outer surfaces of the first and second inner sidewalls define a second cavity, the second cavity box shaped and complementary to the insulating and sealing member and received therein, wherein the first and second inner endwalls and the first and second inner sidewalls are reliant on the insulating and sealing member for shape; and wherein the supplemental cover has a length in a range from 70 inches to 85 inches, a width in a range from 40 inches to 50 inches, and a height in a range from 15 inches to 25 inches;

insulation cut from a roll disposed in the interior chamber having a second R-value greater than R-20 and wherein the first and second outer endwalls, the first and second outer sidewalls, and the top and bottom panels are reliant on the insulation for shape; and a total system R-value found by summing the first R-value and the second R-value, wherein the total system R-value is at least R-38.

* * * * *

UNITED STATES PATENT AND TRADEMARK OFFICE

CERTIFICATE OF CORRECTION

PATENT NO. : 9,222,265 B2
APPLICATION NO. : 14/510569
DATED : December 29, 2015
INVENTOR(S) : Richmond et al.

It is certified that error appears in the above-identified patent and that said Letters Patent is hereby corrected as shown below:

In the Claims

Column 9, line 61 (Claim 1) change "the to panel" to --the top panel--

Column 10, line 2 (Claim 1) change "the to panel" to --the top panel--

Column 10, line 58 (Claim 4) change "the to panel" to --the top panel--

Signed and Sealed this
Twenty-second Day of March, 2016

Michelle K. Lee

Michelle K. Lee
*Director of the United States Patent and Trademark Office*